United States Patent [19]

Stec

[11] Patent Number: 4,581,765

[45] Date of Patent: Apr. 8, 1986

[54] INFORMATION SECURITY SYSTEM

[75] Inventor: Kevin Stec, Marlton, N.J.

[73] Assignee: Matsushita Electric Industrial Co., Ltd., Kadoma, Japan

[21] Appl. No.: 466,007

[22] Filed: Feb. 14, 1983

[51] Int. Cl.[4] ..... H04K 1/00

[52] U.S. Cl. ..... 455/29; 179/1.5 FS; 358/114; 358/121

[58] Field of Search ..... 179/1.5 FS; 455/29; 358/114, 121

[56] References Cited

U.S. PATENT DOCUMENTS

| | | | |
|---|---|---|---|
| 2,509,716 | 5/1950 | Aubert | 179/1.5 FS |
| 3,824,468 | 7/1974 | Zegers et al. | 455/29 |
| 4,216,500 | 8/1980 | St. Louis | 358/114 |
| 4,276,652 | 6/1981 | McCalmont et al. | 179/1.5 FS |
| 4,389,671 | 6/1983 | Posner et al. | 358/121 |
| 4,398,216 | 8/1983 | Field et al. | 358/121 |
| 4,410,911 | 10/1983 | Field et al. | 358/121 |

*Primary Examiner*—S. C. Buczinski

*Attorney, Agent, or Firm*—Morton Amster; Jesse Rothstein; Daniel S. Ebenstein

[57] ABSTRACT

A system is disclosed for encoding and decoding the audio signal portion of a television signal to prevent unauthorized reception of the audio signal. At the encoding stage, the audio signal is applied to a multiplier which combines the audio signal with a programmable carrier having a frequency controlled by a frequency selection protocol to produce an output signal which is spectrally inverted from the original audio signal. The spectrally inverted signal from the multiplier is applied to a sideband filter which filters out the upper sideband of the spectrally inverted signal to produce an encoded signal having the same bandwidth as that of the original audio signal. At the decoding stage, the carrier signal is phase-shifted to compensate for phase delay imparted to the encoded signal in the encoding process and combined with the encoded signal to decode the encoded signal.

4 Claims, 8 Drawing Figures

FIG. 3 ENCODER
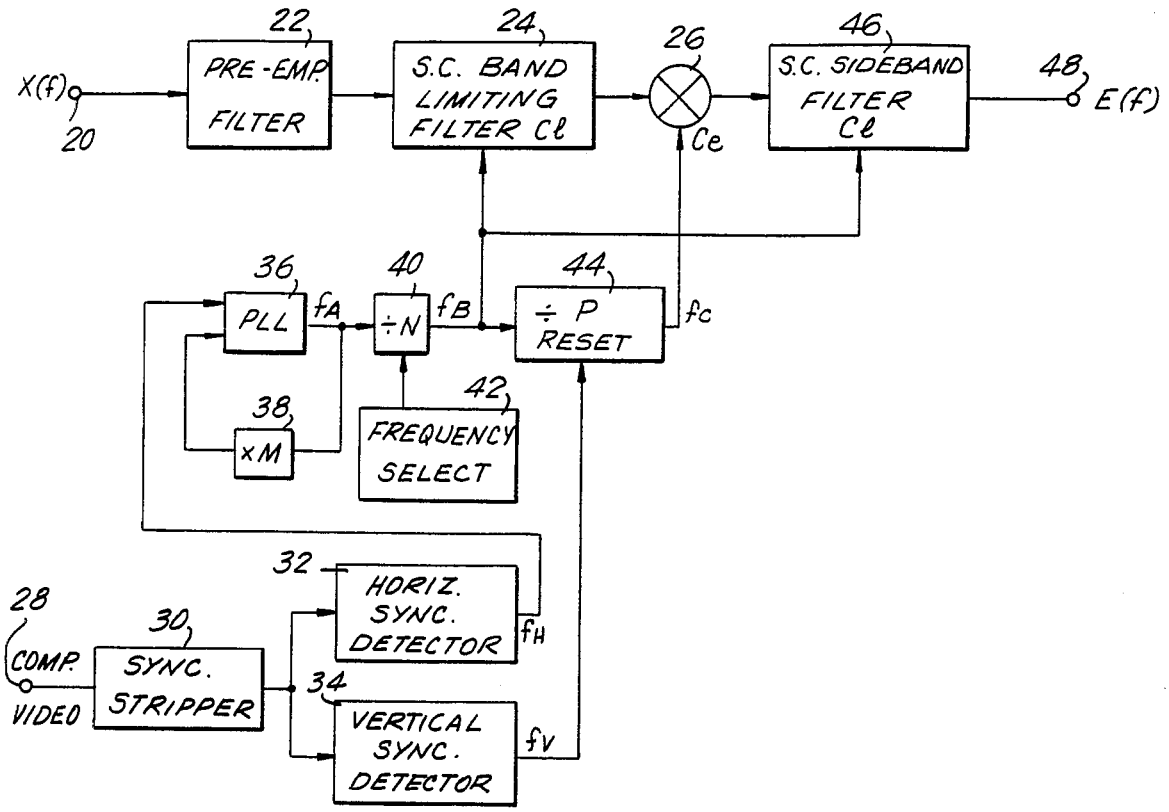
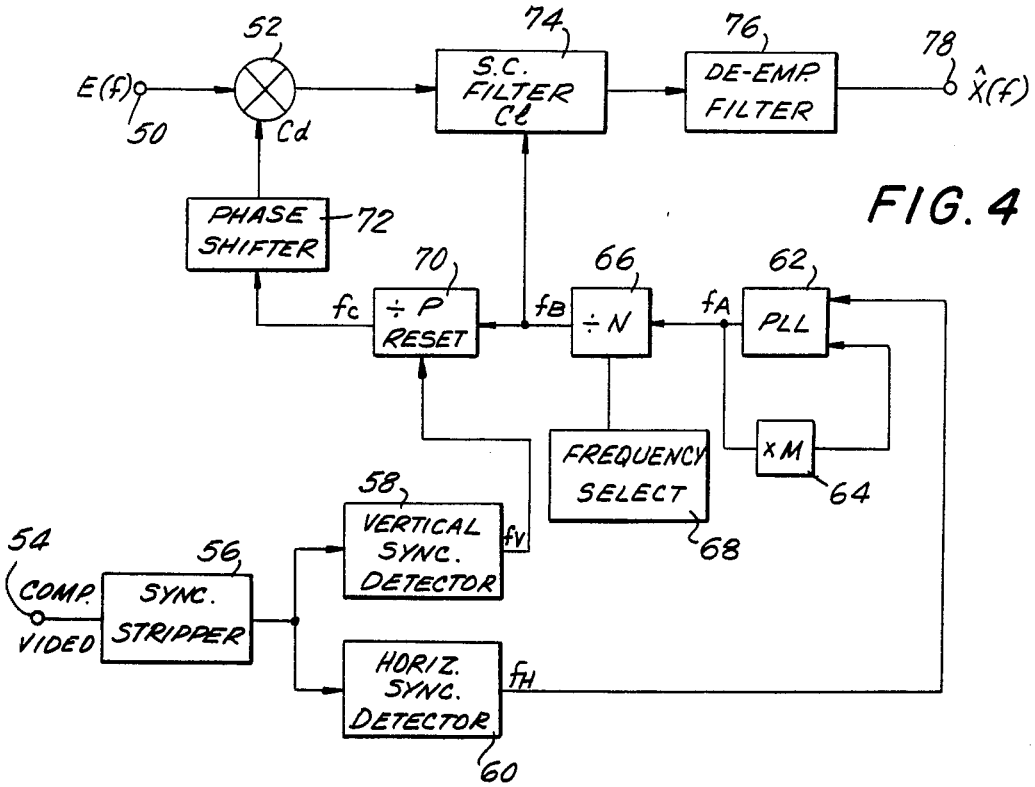
FIG. 4

INFORMATION SECURITY SYSTEM

DESCRIPTION OF THE INVENTION

The invention relates to an information security system for encoding and decoding an information signal to prevent unauthorized reception of the information signal and, in particular, to a system for scrambling an audio signal portion of a television signal prior to transmission and descrambling the audio signal at a television receiver.

There have been many information security systems used and proposed for encoding and decoding an information signal to prevent unauthorized reception of the information signal. For example, an information security system is sometimes added to telephone or wireless equipment for preventing tapping, which system is very expensive and therefore has limited use. Scrambling and descrambling systems for pay television systems are also known. These prior systems, however, did not provide the ability to conveniently program the encoder and decoder so that the encoding/decoding pattern can be changed to complicate the unauthorized reception of the encoded information.

The present invention, therefore, has as its principal object to provide a system for encoding and decoding an information signal to prevent unauthorized reception wherein the encoding/decoding pattern can be readily changed to complicate unauthorized reception of the encoded information.

It is a more specific object of the invention to provide a system for encoding and decoding an audio signal portion of a television signal to prevent unauthorized reception of the audio signal.

It is a further object of the invention to subject the audio signal to be encoded to an encoding selection protocol which affects time-changes in the audio signal.

It is another object of the invention to provide a system for encoding the audio signal portion of the television signal by applying the audio signal to a predetermined frequency protocol to periodically change the frequency spectrum and amplitude characteristics of the audio signal to enable the signal to be encoded prior to transmission.

It is a still further object of the invention to provide a system for decoding which uses a decoding selection protocol synchronized with the encoded information protocol to decode the encoded information signal.

It is another object of the invention to provide a decoding system having a phase shifter for shifting the phase of the decoding selection protocol signal before applying the decoding selection protocol signal to the encoded information.

In accordance with one specific embodiment of the invention, the information is applied to a programmable band limiting filter which limits the band width of the information signal to produce a frequency limited information signal under the control of a programmed clock signal having a frequency controlled by a frequency selection protocol. The programmed clock signal is also used to produce a carrier signal which is combined by a multiplier for frequency inversion with the frequency limited information signal to produce an output signal which is spectrally inverted from the original information signal. The spectrally inverted signal from the multiplier is applied to a side band filter which filters out the upper sideband of the spectrally inverted signal to produce an encoded signal having the same bandwidth as that of the original audio signal. At a decoding stage, the carrier signal is phase-shifted to compensate for phase delay imparted to the encoded signal in the encoding process and combined with the encoded signal to decode the encoded signal.

In a more particular embodiment of the invention, the horizontal synchronous signal of the video portion of the television signal is used to generate a clock signal at a particular frequency. This clock signal is applied to a divider which is programmed in accordance with a frequency selection protocol to produce a clock signal having a frequency which changes in accordance with the frequency selection protocol. The frequency selection protocol can be a one-bit select program which causes the clock frequency to be one of two frequencies. The clock signal is applied to a band limiting filter together with the audio signal to limit the audio signal to freqencies below the carrier frequency and which is divided down to produce a carrier signal. The band limited information signal is combined with the carrier signal then applied to a side band filter whose cut-off frequency is controlled by the clock signal. The lower side band is passed by the side band filter and is the spectrally inverted information signal.

In the decoder, the horizontal synchronous signal of the video portion of the television signal is used to produce a clock signal which is applied to a divider programmed in accordance with and in synchronism with the frequency selection protocol used in the encoder to produce a clock signal and thereafter further divide it for a carrier signal. The carrier signal is phase-shifted to compensate for phase delay through the filter in the encoder. The phase-shifted carrier signal is combined with the encoded audio signal to produce a double side band signal which is applied to a side band filter whose cut-off frequency is controlled by the clock signal. The output of the filter is the original audio signal.

While the novel features of the invention are set forth with particularly in the appended claims, the invention, both as to organization and content, will be better understood and appreciated, along with other objects and features thereof, from the following detailed description taken in conjunction with the drawings, in which:

FIG. 3 is a schematic block diagram of the encoder of the invention; and

FIG. 4 is a schematic block diagram of the decoder of the invention.

Referring to FIG. 1, the principle of encoding in accordance with the invention will be explained. The encoding is carried out by use of a frequency inversion technique. That is, an information signal, for example, an audio signal to be encoded, is combined by a multiplier with a carrier signal and thereby spectrally inverted from the original audio signal. Since the spectrally inverted signal has double the bandwidth of an original audio signal, the upper side band of the spectrally inverted signal is filtered out to produce an encoded signal having the same bandwidth of the original audio signal. The frequency spectrum of the encoded signal can be changed by changing the frequency of the carrier signal. If a plurality of carrier signals having different frequencies are provided for the encoding operation and the selection of the carrier signals is carried out by a frequency selection protocol, the frequency spectrum of the encoded signal is changed in a predetermined time dependent manner, thereby creating timed changes of the audio signal. Unauthorized reception of the encoded signal is therefore very difficult.

Figure 1A:
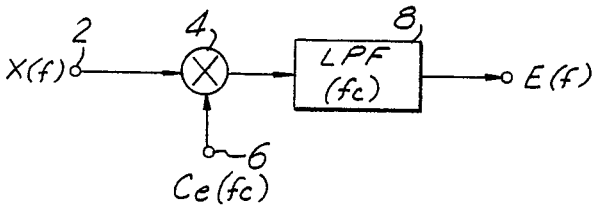
FIG. 1A is a block diagram.
Figure 1B:
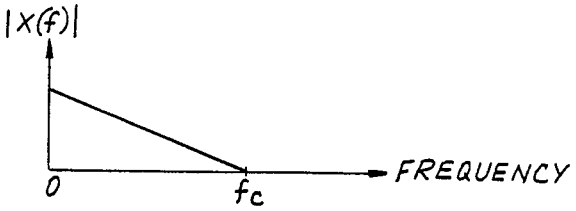
FIGS. 1B and 1C are graphs useful for explaining the principle of operation of an encoder which is included in an information security system of the present invention.
Figure 1C:
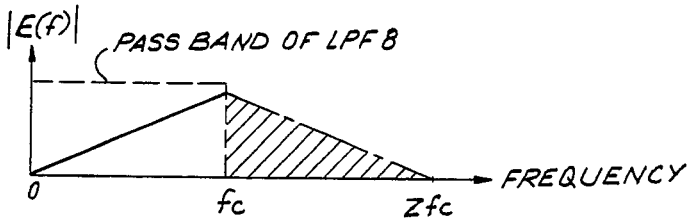

FIG. 1A shows a block diagram of a basic encoder structure. An audio signal X(f) to be encoded is applied to an input terminal 2. The frequency spectrum of the audio signal X(f), as shown in FIG. 1B, has a bandwidth of 0 to $f_c$. The audio signal is applied to a multiplier 4 which receives a carrier signal $C_e$ from a terminal 6. The frequency of the carrier signal $C_e$ is equal or substantially equal to the maximum frequency $f_c$ of the audio signal X(f). The audio signal X(f) is combined by the multiplier 4 with the carrier signal $C_e$ to produce an output signal which is spectrally inverted from the original audio signal X(f). The output signal of the multiplier 4, as shown in FIG. 1C, has twice the bandwidth (0 to $2 \cdot f_c$) of the original audio signal X(f), which means that the output signal is a double side band signal formed around the carrier frequency $f_c$. To obtain an encoded signal E(f) having the same bandwidth as that of the original audio signal X(f), the output signal of the multiplier 4 is applied to a low pass filter (LPF) 8. The cut-off frequency of the LPF8 is the same as the frequency $f_c$ of the carrier signal $C_e$. Therefore, LPF8 has a pass band of 0 to $f_c$ as shown in FIG. 1C. Thus, the output signal of multiplier 4 is band-limited to the frequencies 0 to $f_c$ by the LPF8 and becomes the encoded signal E(f) as shown in the left half of FIG. 1C. By these operations, including: (1) combining the audio signal X(f) with the carrier signal $C_e$ by multiplier 4; and (2) band-limiting the output signal (spectrally inverted signal) of the multiplier 4 by LPF8, the original audio signal X(f) is spectrally inverted to become the encoded signal E(f).

At this encoding stage, if the frequency of the carrier signal $C_e$ is shifted up or down in a predetermined or programmmed manner, the encoded signal E(f) is spectrally changed in response to the shift of the carrier signal frequency. It becomes even more difficult for unauthorized users to receive and decode the encoded signal E(f). For example, two carrier signals having frequencies $f_1$, $f_2$ respectively may be provided for encoding. The duration of each carrier signal and the selection of the carrier signals may be predetermined by a frequency selection protocol, for example: $f_1$ for $t_1$ secs; $f_2$ for $t_2$ secs; $f_1$ for $t_3$ secs; $f_2$ for $t_4$ secs; and repeat (where $t_1$, $t_2$, $t_3$ and $t_4$ are different time durations). The degree of information security can be changed by changing the number of carrier signals used in the encoding, the duration of each carrier signal, and the sequence that the carrier signals are used.

Referring to FIG. 2, the principle of the decoding operation is explained. The encoded signal is decoded to obtain the original audio signal by using the same frequency inversion technique as used in the encoding stage. That is, the encoded signal is combined by a multiplier with a carrier signal for decoding to produce a spectrally inverted signal. The spectrally inverted signal is band limited by a low pass filter for decoding to reproduce the original audio signal. The frequency of the carrier signal for decoding should be the same as that of the encoding carrier signal. If the frequency of the encoding carrier signal is shifted up or down in a programmed manner, the frequency of the decoding carrier signal is shifted in the same manner and synchronized with the encoding carrier signal.

Figure 2A:
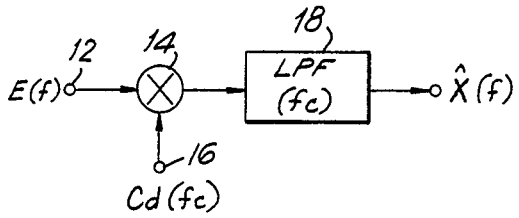
FIG. 2A is a block diagram.
Figure 2B:
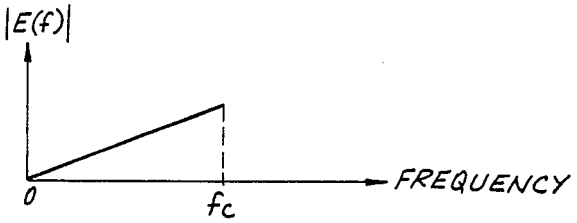
FIGS. 2B and 2C are graphs useful for explaining the principle of operation of a decoder which is included in the information security system of the present invention.
Figure 2C:
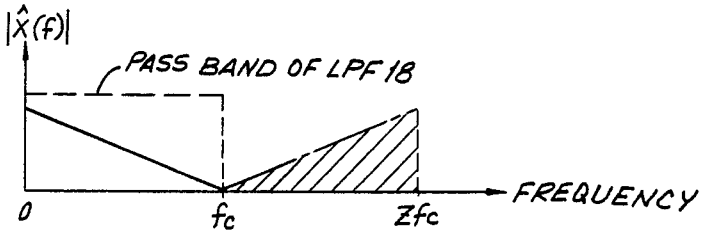

FIG. 2A shows a block diagram of a basic decoder structure. The encoded signal E(f) having the frequency spectrum which is shown in FIG. 2B is applied to a multiplier 14 through an input terminal 12. The multiplier 14 also receives a carrier signal Cd for decoding, which carrier signal has the same frequency as the carrier signal Ce used to encode the signal. The multiplier 14 combines the encoded signal E(f) with the carrier signal Cd for decoding to produce an output signal which is spectrally inverted from the encoded signal E(f). The frequency spectrum of the output signal of multiplier 14, as shown in FIG. 2C, is double side band signal formed around the carrier frequency $f_c$ having bandwidth from 0 to $2f_c$. The output signal is then applied to a low pass filter (LPF) 18 for decoding, the cut-off frequency of low pass filter 18 is the same as the frequency $f_c$ of the carrier signal $C_d$ used for decoding. Therefore, the LPF 18 band-limits the output signal of the multiplier 18 to the frequency band 0 to $f_c$ and then produces the decoded signal which is the same as the original audio signal X(f), as shown in the left half of FIG. 2C.

If a plurality of carrier signals Ce are used for encoding in the encoding stage, the same number of carrier signals Cd must be used in the decoding stage for decoding. The frequencies of both carrier signals Ce and Cd must be the same and synchronized with each other. The use of a plurality of carrier signals complicates the encoded signal pattern and therefore makes unauthorized reception of the encoded signal more difficult. For example, if two frequencies are used for the carrier signal Ce for encoding, the frequency selection protocol may be a one-bit program selection ("0" or "1") which causes the frequency of the carrier signal to alternate. The same carrier frequency alternation program must be used for decoding. When the carrier signal frequency is shifted, the cut-off frequency of LPF 8, 18 may be changed in accordance with the shifting of the carrier signal frequency. To accomplish the change of the LPF cut-off frequency, a switched-capacitor type filter may be used. The switched-capacitor type filter includes a plurality of capacitors and a switching device for selecting one of the capacitors to determine the cut-off frequency of the filter. The switching device automatically performs its switching operation in accordance with the changing frequency of a clock signal applied to the filter. Therefore, the optimum operation would be obtained by changing the frequencies of both the carrier signal and the clock signal for filter.

It has been empirically found that spacing of carrier signal frequencies, at approximately 1 KHz or more between the frequencies of encoding and decoding carrier signals, produces a decoded output that is unintelligible. Therefore, if the encoding carrier signals have a frequency spacing of about 1 KHz, only decoders that are switched and synchronized to the proper carrier signal can decode the information.

The carrier signal Cd for decoding may be phase-shifted before applying the same to the multiplier 14 to compensate for phase delay reported to the encoded signal in the encoding stage. Since ideal filtering is not possible, the upper side band of the output signal of the multiplier 4 (see, FIG. 1C) is not completely removed by the LPF 8 in the encoding stage. The result, when such signal is decoded, would be a boost in the low frequency end of the decoded signal spectrum due to the upper side band contribution in addition to the lower side band components. The residual upper side band is phase-shifted with respect to the corresponding lower side band components when they pass through the low-pass filter. This results in a frequency non-linearity in the lower portion of the decoded signal spectrum. The high frequency portion of the spectrum is not affected because the corresponding upper side band components are attenuated by the low pass filter. To compensate for the above effect, the encoded signal is decoded by a synchronous carrier signal which is phase-shifted with respect to the encoding carrier signal by an amount $\emptyset$ which is determined by the amplitude and phase characteristics of the low pass filter.

Particular circuits for encoding and decoding will now be explained with reference to FIGS. 3 and 4 which are schematic block diagrams of one embodiment of an encoder and decoder, respectively. In this embodiment, the information signal to be encoded is an audio signal portion of a conventional television signal. Therefore, the encoder is assembled in or attached to a conventional television transmitter and the decoder is assembled in or attached to a conventional television receiver. A plurality of carrier signals are used for encoding and necessarily for decoding. The carrier signals are derived from the horizontal synchronous signal of the video signal portion of the television signal. That is, a clock signal is produced from the horizontal synchronous signal and the clock signal frequency is divided to produce the carrier signal. The clock signal is also used for changing the cutoff frequency of the filter which filter is the switched-capacitor filter. Also, pre-emphasis of the signal to be encoded and de-emphasis of the decoded signal are used at the encoder and decoder respectively to improve the signal-to-noise ratio (S/N) and dynamic range of the whole encoding/decoding system.

In FIG. 3, an input terminal 20 receives an audio signal X(f) to be encoded, which signal is the audio signal portion of the television signal. The audio signal X(f) is applied to a pre-emphasis filter 22 and pre-emphasized thereby to improve the S/N and dynamic range of the system. The pre-emphasized audio signal is applied to a band limiting filter 24 comprising a switched-capacitor filter which limits the bandwidth of the audio signal to 0 to $f_c$ to prevent aliasing. The output signal of the filter 24 is applied to a multiplier 26 which receives a carrier signal Ce for encoding. The carrier signal Ce, as stated above with reference to FIG. 1, has the maximum frequency $f_c$ of the audio signal and is produced, for example, as follows: Three carrier signals for encoding are used whose frequencies $f_{c1}$, $f_{c2}$, $f_{c3}$ (collectively, $f_c$ as shown in FIG. 3) are as follows:

$$f_{c1}=14\times15\times60=12.6\text{ KHz}$$

$$f_{c2}=14\times16\times60=13.44\text{ KHz}$$

$$f_{c3}=15\times16\times60=14.4\text{ KHz}$$

where, 14, 15, 16 are programmable divisors N for frequency selection which will be explained in detail below and 60 is an arbitrary number which is determined so that the product of two of the three divisors N and the arbitrary number fall within the audio frequency under 20 KHz. Since there are three carrier signals, the number of clock signals for changing the filter cut-off frequency is necessarily three. The frequencies $f_{B1}$, $f_{B2}$, $f_{B3}$ (collectively $f_B$ as shown in FIG. 3) of the three clock signals are calculated as follows:

$$f_{B1}=f_{C1}\times100=126\text{ KHz}$$

$$f_{B2}=f_{C2}\times100=134.4\text{ KHz}$$

$$f_{B3}=f_{C3}\times100=144\text{ KHz}$$

where, 100 is a ratio of the frequencies of the filter clock signal and the carrier signal and can be changed in response to the cut-off frequency of the filter. To obtain the above two kinds of frequencies $f_c$ and $f_B$, it is necessary to generate a pre-selected signal having the following frequency $f_A$.

$$f_A=14\times15\times16\times60\times100=20.16\text{ MHz}$$

Since the horizontal synchronous signal frequency $f_H$ of the television signal is 15.75 KHz, it can be seen that $f_A=1280.f_H$, so that the clock signal can be generated by multiplying the horizontal synchronous frequency by 1280.

Returning to FIG. 3, a terminal 28 receives a television composite video signal to be transmitted which is then applied to a synchronous signal stripper 30, and thereafter applied to a horizontal synchronous signal detector 32 and a vertical synchronous signal detector 34. The horizontal synchronous signal detector 32 detects the horizontal synchronous signal from the video signal of the television signal and produces the horizontal synchronous signal of frequency $f_H$. The vertical synchronous signal detector 34 detects the vertical synchronous signal and produces the vertical synchronous signal of frequency $f_V$. The horizontal synchronous signal H is applied to a phase-locked-loop (PLL) circuit 36 as a stabilizer which stabilizes the horizontal synchronous signal. A multiplier 38 is combined with the PLL circuit 36 to produce the frequency $f_A$ by multiplying the horizontal synchronous frequency $f_H$ by multipler M which is, in this case, 1280, as stated above. The stabilized output signal $f_A$ of the PLL circuit 36 is applied to a divider 40 to produce the clock signal frequency $f_B$ by dividing the frequency $f_A$ by divisor N which is, in this case, 14, 15, 16 as stated above. The divisors N of the divider 40 are selected one by one in accordance with a frequency selection protocol signal produced by a frequency selection circuit 42. The protocol is, in this example, a two-bit program so that if "00" is applied to the terminal 42, "14" is selected as the divisor N of the divider 40. An example of the relationship between the two-bit signal and selected divisor is shown in the following table:

| two bit signal | selected divisor |
|---|---|
| 00 | 14 |
| 01 | 15 |
| 11 | 16 |

The frequency selection protocol also includes the information specifying the duration for applying the two-bit signal and the selection sequence of the two-bit signal. The protocol is previously programmed in a conventional manner in a microcomputer of the frequency selection circuit 42, particularly in a read-only memory (ROM), but can be changed readily by replacing the ROM or the re-programming. The output signal $f_B$ of the divider 40 is applied to a counter 44 which functions as a divider for producing the carrier signal frequency $f_C$ by dividing the clock signal frequency $f_B$ by the arbitrary number P, in this case 100, as stated above. The counter 44 is reset by the vertical synchronous frequency $f_V$ to make the carrier signal frequency $f_C$ multiple of the vertical synchronous frequency $f_V$ so that it can be phase-locked between encoder and decoder.

As is apparent from the foregoing, the carrier signal is produced by the following way: (1) detect the horizontal synchronous signal from the video signal of the television signal; (2) stabilize the horizontal synchronous signal and multiply it by M (for example, 1280) to produce the pre-selected signal; (3) divide the pre-selected signal frequency $f_A$ by N (for example, 14, 15, 16) to produce the clock signal frequency $f_B$; and (4) further divide the clock signal frequency $f_B$ by P (for example, 100) to produce the carrier signal frequency $f_C$.

The clock signal $f_B$ from the divider 40 is applied to the band limiting filter 24 and a side band filter 46, both of which comprise switched-capacitor filters to control the cut-off frequency of the filters. The carrier signal $f_C$ is applied to the multiplier 26 and combined thereby with the band-limited audio signal from the filter 24 to produce the spectrally inverted double side band signal as shown in FIG. 1C. The spectrally inverted signal is applied to the side band filter 46 which, in turn, filters out the upper side band of the spectrally inverted signal to produce the encoded signal E(f) which appears on the output terminal 48. This encoded (audio) signal E(f) is then transferred to the television transmitter (not shown) as well as the video signal to be transmitted to remote television receivers.

FIG. 4 shows a schematic block diagram of the decoder. The transmitted signal from the television transmitter is received by a conventional television receiver. The encoded (audio) signal E(f) is reproduced by a conventional television receiver circuit (not shown) and applied to a multiplier 52 via a terminal 50, which multiplier 52 receives a carrier signal Cd for decoding. As stated above, the decoding carrier signal Cd has the same frequency as that of the encoding carrier signal Ce and these two kinds of carrier signals Cd, Ce are synchronized with each other. To accomplish the above, the same circuits for producing the carrier signals as in the encoding stage are used in the decoding stage. The circuits will now be explained.

A terminal 54 receives a television composite video signal produced by the television receiver circuit. The video signal is applied to a synchronous signal stripper 56 and then, to a vertical synchronous signal detector 58 and a horizontal synchronous signal detector 60. These two detectors 58, 60 have the same function as those of the detectors 34, 32 in FIG. 3 and, therefore, produce the vertical and horizontal synchronous signals of frequencies $f_V$, $f_H$, respectively. The horizontal synchronous signal detected by the detector 60 is applied to a PLL circuit 62 as a stabilizer to stabilize the horizontal synchronous signal and synchronize the same with the horizontal synchronous signal in the encoding stage. A multiplier 64 is combined with the PLL circuit 62 to produce the pre-selected signal of frequency $f_A$ by multiplying the horizontal synchronous frequency $f_H$ by M, in this case, 1280. The stabilized output signal $f_A$ of the PLL circuit 62 is applied to a divider 66 to produce a clock signal frequency $f_B$ by dividing the frequency $f_A$ by N, in this case, 14, 15 or 16. The divider 66 is controlled by the same frequency selection protocol as in the encoding stage to produce the clock signal frequency $f_B$ synchronized with the counterpart in the encoding stage. The frequency selection protocol is programmed in a microcomputer of a frequency selection circuit 68 in the same manner as in the encoder. The clock signal from the divider 66 is applied to a counter 70 which functions as a divider to produce a carrier signal Cd by dividing the clock signal frequency $f_B$ by the arbitrary number P, in this case, 100. The counter 70 is reset by the vertical synchronous signal detected by the detector 58 to synchronize the carrier signal Cd for decoding with the carrier signal Ce for encoding. The carrier signal from the counter 70 is applied to the multiplier 52 via a phase-shifter 72 to compensate for phase delay imparted to the encoded signal in the encoding stage. The multiplier 52 combines the carrier signal Cd with the encoded signal E(f) to produce the spectrally inverted double side band signal as shown in FIG. 2C. The spectrally inverted signal is then applied to a side band filter 74, which comprises a switched-capacitor filter and filters out the upper side band of the spectrally inverted signal. The clock signal $f_B$ from the divider 66 is applied to the clock terminal C1 of the filter 74 to control its cut-off frequency. The output signal of the filter 74 is applied to a de-emphasis filter 76 to produce the original audio signal X(f) on terminal 78.

Since the present system uses carrier signals spaced approximately 1 KHz apart, attempts to decode with the wrong carrier signal will result in speech that is virtually unintelligible. Also, since the clock signal and carrier signal are derived from the same source, the horizontal synchronous signal, they can track each other and this aids in maintaining a relatively flat frequency response whether one carrier signal or another is used. As can be seen from the foregoing and the diagrams, effectively, the same method is used to decode the audio signal as is used to encode it. While the audio signal is used as one example of the information signal in the above embodiment, other signals, such as video signal or digital signal, can be encoded and decoded in the same manner. In summary, the information signal includes all signals which are included within a known frequency band.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A system for encoding an information signal included within a known frequency band comprising:

means for producing a frequency selection protocol signal;

means for producing a pre-selected signal;

means responsive to said frequency selection protocol signal and said pre-selected signal for producing a clock signal, the frequency of said clock signal being changed in accordance with the frequency selection protocol signal to create pre-selected changes in the clock signal frequency;

means responsive to the clock signal for producing a carrier signal with a carrier frequency having a selected relationship to the frequency of said clock signal;

means for combining the information signal with the carrier signal to produce a spectrally inverted information signal; and means responsive to said spectrally inverted information signal for producing an encoded information signal having substantially reduced frequency components at least above the frequency of the carrier signal, said means for producing said encoded information signal including filter means having a control terminal coupled to receive said clock signal, the cut-off frequency of said filter means being changed in accordance with said clock signal received on said control terminal.

2. The system of claim 1 wherein said filter means is a switched-capacitor filter.

3. A system for decoding an encoded information signal which is produced by spectrally inverting an information signal included within a known frequency band, comprising:

means for producing a frequency selection protocol signal;

means for producing a pre-selected signal;

means responsive to said frequency selection protocol signal and said pre-selected signal for producing a clock signal, the frequency of said clock signal being changed in accordance with the frequency selection protocol signal to create pre-selected changes in the clock signal frequency;

means responsive to the clock signal for producing a carrier signal with a carrier frequency having a selected relationship to the frequency of said clock signal;

means for combining the encoded information signal with the carrier signal to produce a spectrally inverted encoded signal; and means responsive to said spectrally inverted encoded signal to produce a decoded information signal having substantially reduced frequency components at least above the frequency of the carrier signal, said means for producing said decoded information signal including filter means having a control terminal coupled to receive said clock signal, the cut-off frequency of said filter means being changed in accordance with said clock signal received on said control terminal.

4. The system of claim 3 wherein said filter means is a switched-capacitor filter.

* * * * *